US006528948B1

(12) United States Patent
Hershcovitch et al.

(10) Patent No.: US 6,528,948 B1
(45) Date of Patent: Mar. 4, 2003

(54) PLASMA VALVE

(75) Inventors: Ady Hershcovitch, Mount Sinai, NY (US); Sushil Sharma, Hinsdale, IL (US); John Noonan, Naperville, IL (US); Elbio Rotela, Clarendon Hills, IL (US); Ali Khounsary, Hinsdale, IL (US)

(73) Assignee: Brookhaven Science Associates LLC, Upton, NY (US)

( * ) Notice: Subject to any disclaimer, the term of this patent is extended or adjusted under 35 U.S.C. 154(b) by 215 days.

(21) Appl. No.: 09/685,227

(22) Filed: Oct. 11, 2000

(51) Int. Cl.[7] ..... H01J 7/24

(52) U.S. Cl. ..... 315/111.71; 315/111.21; 315/111.31; 315/111.61; 313/178; 219/121.48; 219/121.57

(58) Field of Search ..... 315/111.21, 111.31, 315/111.61, 111.71; 313/178, 198, 214, 231.31, 231.41; 219/121.48, 121.57, 121.59

(56) References Cited

U.S. PATENT DOCUMENTS

| | | | | |
|---|---|---|---|---|
| 3,814,503 A | | 6/1974 | Milam | 350/160 R |
| 3,866,075 A | * | 2/1975 | Grissom et al. | 313/178 |
| 4,194,813 A | | 3/1980 | Benjamin et al. | 350/363 |
| 4,257,017 A | | 3/1981 | Bradley et al. | 332/7.51 |
| 4,728,862 A | | 3/1988 | Kovarik et al. | 315/111.01 |
| 5,033,355 A | * | 7/1991 | Goldstein et al. | 315/111.21 |
| 5,148,129 A | | 9/1992 | Bolton | 333/20 |
| 5,299,068 A | | 3/1994 | Cohn et al. | 359/886 |
| 5,578,831 A | | 11/1996 | Hershcovitch | 250/398 |
| 6,084,198 A | * | 7/2000 | Birx | 315/111.31 |

OTHER PUBLICATIONS

Hershcovitch, et al., "Plasma Window as a Fast Vacuum Valve," Abstract, Bulletin APS 44, vol. 11, 165, Nov. 99, internet availability possibly in Oct. 99.

Hershcovitch, "High–pressure arcs as vacuum–atmosphere interface and plasma lens for nonvacuum electron beam welding machines, electron beam melting, and nonvacuum ion material modification," J. Appl. Phys. 78 (9), Nov. 1, 1995, pp. 5283–5288.

Hershcovitch, "A plasma window for vacuum–atmosphere interface and focusing lens of sources for nonvacuum ion material modification (invited)," R. of Sci. Instru. vol. 69, No. 2, 2/98, pp. 868–873.

Hershcovitch, "A plasma window for transmission of particle beams and radiation from vacuum to atmosphere for various applications," Phys. Plasmas, vol. 5, No. 5, May 1998, pp. 2130–2136.

Gerber, et al., "The Plasm Porthole: a Windowless Vacuum–Pressure Interface with Various Accelerator Applications," presented Nov. 7, 1998, four pages.

Hershcovitch, et al., "The Plasma Window: A Windowless High Pressure–Vacuum Interface for Various Accelerator Applications," presented Apr. 2, 1999, three pages.

* cited by examiner

*Primary Examiner*—Don Wong
*Assistant Examiner*—Jimmy T. Vu
(74) *Attorney, Agent, or Firm*—Margaret C. Bogosian

(57) ABSTRACT

A plasma valve includes a confinement channel and primary anode and cathode disposed therein. An ignition cathode is disposed adjacent the primary cathode. Power supplies are joined to the cathodes and anode for rapidly igniting and maintaining a plasma in the channel for preventing leakage of atmospheric pressure through the channel.

16 Claims, 4 Drawing Sheets

PLASMA VALVE

This invention was made with Government support under contract number DE-AC02-98CH10886, awarded by the U.S. Department of Energy. The Government has certain rights in the invention.

BACKGROUND OF THE INVENTION

The present invention relates generally to electromagnetic and particle beam radiation, and, more specifically, to transmission thereof in high vacuum.

Such radiation beams have many uses in various commercial industries, scientific studies, and experimental research. Radiation beams may be generated with substantial energy therein in various beam generators. The beam generators are typically operated under various levels of vacuum including high and ultra-high vacuum as required.

For example, the National Synchrotron Light Source (NSLS) at Brookhaven National Laboratory provides two evacuated storage rings with a substantial number of experimental stations thereat. Photon energy from 10 eV to 20 keV in the form of infrared light, ultraviolet light, and x-rays are available for use in experiments. Furthermore, the Advance Photon Source (APS) at the Argonne National Laboratory is also available for using x-rays in experiments. In both systems, the beams are circulated in corresponding storage rings which are evacuated to suitable levels of vacuum for maintaining the efficacy of the beam. The experimental or test stations are located at the end of corresponding beamlines or extraction tubes through which the beam is extracted for testing purposes.

The extraction tube includes several valves for isolating the test stations from the storage ring when required. During testing, the valves are open for permitting extraction of the beam while maintaining the normal level of vacuum in the storage ring.

However, in the event of any damage in the test station in which a vacuum leak occurs, the test station must be quickly isolated from the storage ring by closing one or more of the valves in the extraction tube to prevent loss of the normal vacuum in the storage ring.

This isolation must occur extremely rapidly, and is effected using mechanical valves in which a valve piece is rapidly driven to engage a cooperating valve seat and close the beamline path from the storage ring.

Due to inherent limitations of mechanical valves, the fastest valves for this use have a limited closure time typically on the order of a few milliseconds. And, this fast closing time typically results in damage to the valve which then requires its repair prior to being reused.

Accordingly, it is desired to provide a fast-acting valve for use in closing a beamline under vacuum while permitting unobstructed beam travel when the valve is open.

BRIEF SUMMARY OF THE INVENTION

A plasma valve includes a confinement channel and primary anode and cathode disposed therein. An ignition cathode is disposed adjacent the primary cathode. And, power supplies are joined to the cathodes and anode for rapidly igniting and maintaining a plasma in the channel for preventing leakage of atmospheric pressure through the channel.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
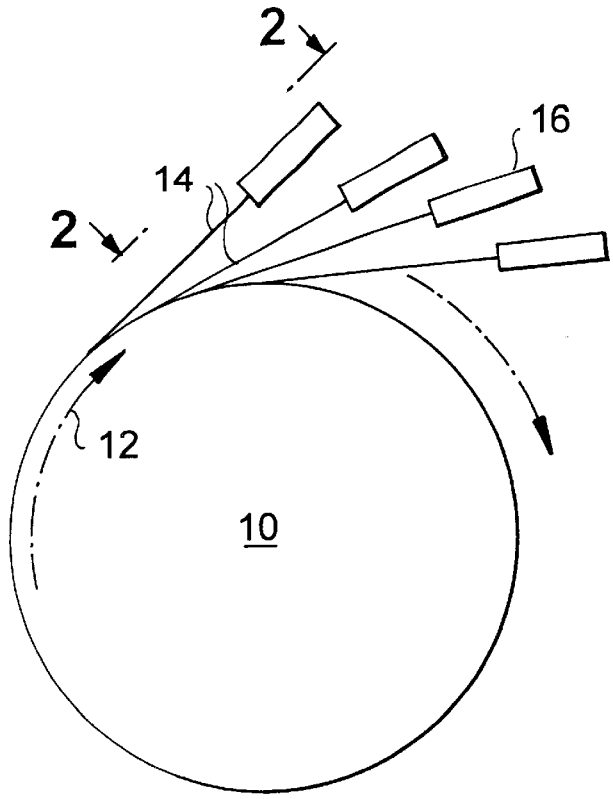
FIG. 1 is a schematic view of an evacuated storage ring for circulating a radiation beam therethrough for extraction at a plurality of extraction tubes around the circumference thereof.

Illustrated schematically in FIG. 1 is an evacuated storage ring 10 in tubular form for circulating an electron beam therearound to generate a radiation beam 12 therefrom. The storage ring includes a plurality of straight beamlines or extraction tubes 14 operatively joined to the ring for receiving the radiation beam 12 therefrom.

Several of the many extraction tubes 14 are illustrated schematically in FIG. 1, with additional extraction tubes also being located around the entire circumference of the ring. The storage ring is maintained under vacuum, such as ultrahigh vacuum of about 10–10 Torr. The radiation beam 12 is conventionally generated by the circulating electron beam in the ring for extraction from any of the tubes for use as desired.

For example, the storage ring 10 may be in the conventional form of the National Synchrotron Light Source (NSLS) maintained and operated at the Brookhaven National Laboratory. The radiation beam at this facility has photon energies in the range of 10 eV to 20 keV including electromagnetic radiation corresponding with x-rays, ultraviolet light, and infrared light. Such beams are used for conducting various experiments located in corresponding user stations 16 at the end of the extraction tubes.

The storage ring 10 may also be in the form of the Advanced Photon Source (APS) maintained and operated at the Argonne National Laboratory which provides a facility for conducting tests using high energy x-ray radiation.

The radiation beam may also have other forms including charged particles such as electron beams used in welding and melting, or ion beams used in material modification, for example. Or, neutron beams may also be used for various applications.

In all these examples, the radiation beam of various form is generated and maintained under various levels of vacuum including ultrahigh vacuum as indicated above, as well as high vacuum of about 10–5 Torr.

Figure 2:
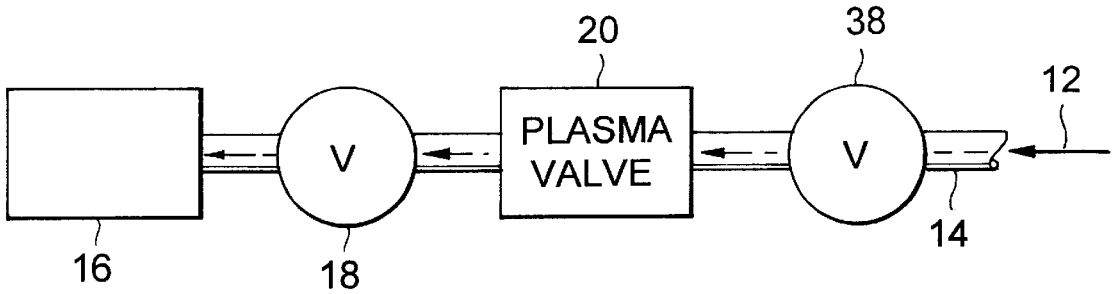
FIG. 2 is a schematic view of an exemplary extraction tube illustrated in FIG. 1 and taken along line 2—2 including various valves therein for controlling operation of the extraction tube.

FIG. 2 illustrates schematically an exemplary one of the extraction tubes 14 which extract a portion of the radiation beam 12 from the storage ring maintained under vacuum. Other forms of beam generators under vacuum may also be used with the exemplary extraction tube 14.

Since the beam 12 travels in a vacuum through the extraction tube 14 illustrated in FIG. 2, one or more suitable valves are provided therein for interrupting the beamline to maintain vacuum when required. For example, the experimental or test station 16 is located at the end of each of the extraction tubes in which experiments or other uses for the beam are conducted. Each station must be sealingly joined to the extraction tube for maintaining vacuum therein during use.

Accordingly, the extraction tube includes a first valve 18 near its distal end which may be used for sealing the tube and containing vacuum therein when beam delivery to the station 16 is not required. When the beam is required, the first valve 18 is simply opened for permitting a direct beam path to the station through which the beam is transmitted under vacuum. The first valve 18 may have any conventional form, and includes a corresponding valve or stem which engages a valve seat for sealing against vacuum loss when required.

During operation of the station 16, a vacuum leak to the atmosphere may occur which requires the immediate isolation of the station from the extraction tube to prevent degradation of the vacuum in the tube and in the storage ring. In the NSLS or APS examples identified above, fast acting shutter valves are found in the extraction tubes thereof. These valves are actuated either mechanically, electro-mechanically, pneumatically, or a combination thereof and have limited closure times due to the mechanical components thereof. The current state of the art includes such mechanical valves which may close within a few milliseconds. And, such quick closing times typically result in inherent damage to these valves when actuated, which in turn requires repair or replacement thereof in which another valve located in the beamline must be closed upbeam therefrom.

Depending upon the extent of the initial vacuum leak and level of vacuum maintained in the storage ring, the millisecond operation of such valves may be insufficient for preventing undesirable degradation of the vacuum.

Accordingly, it is desired to provide a substantially faster closing valve for preventing loss of vacuum, including ultrahigh vacuum in the beamline of various forms including those associated with the storage ring 10.

In a previous development patented in U.S. Pat. No. 5,578,831 a plasma window is disclosed which is configured for generating a high or atmospheric pressure plasma which permits beam transmission therethrough yet prevents vacuum loss from the beamline.

That plasma window may be modified in accordance with the present invention for use as a plasma valve 20 illustrated schematically in FIG. 2 disposed in series in the extraction tube 14 for channeling the beam 12 therethrough when the plasma valve is de-energized, and for blocking vacuum loss therethrough by the generated plasma when the plasma valve is energized. Unlike the plasma window disclosed in that patent, the plasma valve is specifically configured for rapidly generating a high pressure plasma to prevent vacuum loss in the beamline, with beam transmission therethrough being irrelevant for this example of intended use.

Since the plasma valve 20 includes various features from the plasma window of that patent, U.S. Pat. No. 5,578,831 is incorporated herein by reference for the basic teachings thereof as used in the present invention, and as further modified for enhanced performance as a plasma valve.

In accordance with the present invention, the plasma valve 20 is operated to quickly generate a high pressure plasma to prevent vacuum loss in the beamline. However, the plasma window of Patent '831 has an unacceptably slow actuation time in view of its configuration for use as a plasma window. The plasma window is ignited in a low pressure glow discharge mode in a low vacuum about 0.2 Torr with low electrical current of less than about 300 milliampere with a corresponding ignition voltage within the range of 2–20 kV.

The cathode used in the plasma window is thusly heated by ionic bombardment until it becomes white hot and emits electrons, at which time the discharge is switched to arc mode characterized by high current greater than about 10 ampere and a low voltage less than about 100 volts. A plasma-forming gas is next injected in the plasma window for raising the arc pressure to about one atmosphere or more for opposing vacuum loss in a collective process which takes more than about one second. This one-second plasma forming process is too slow for use in the beamline of FIG. 2.

Figure 3:
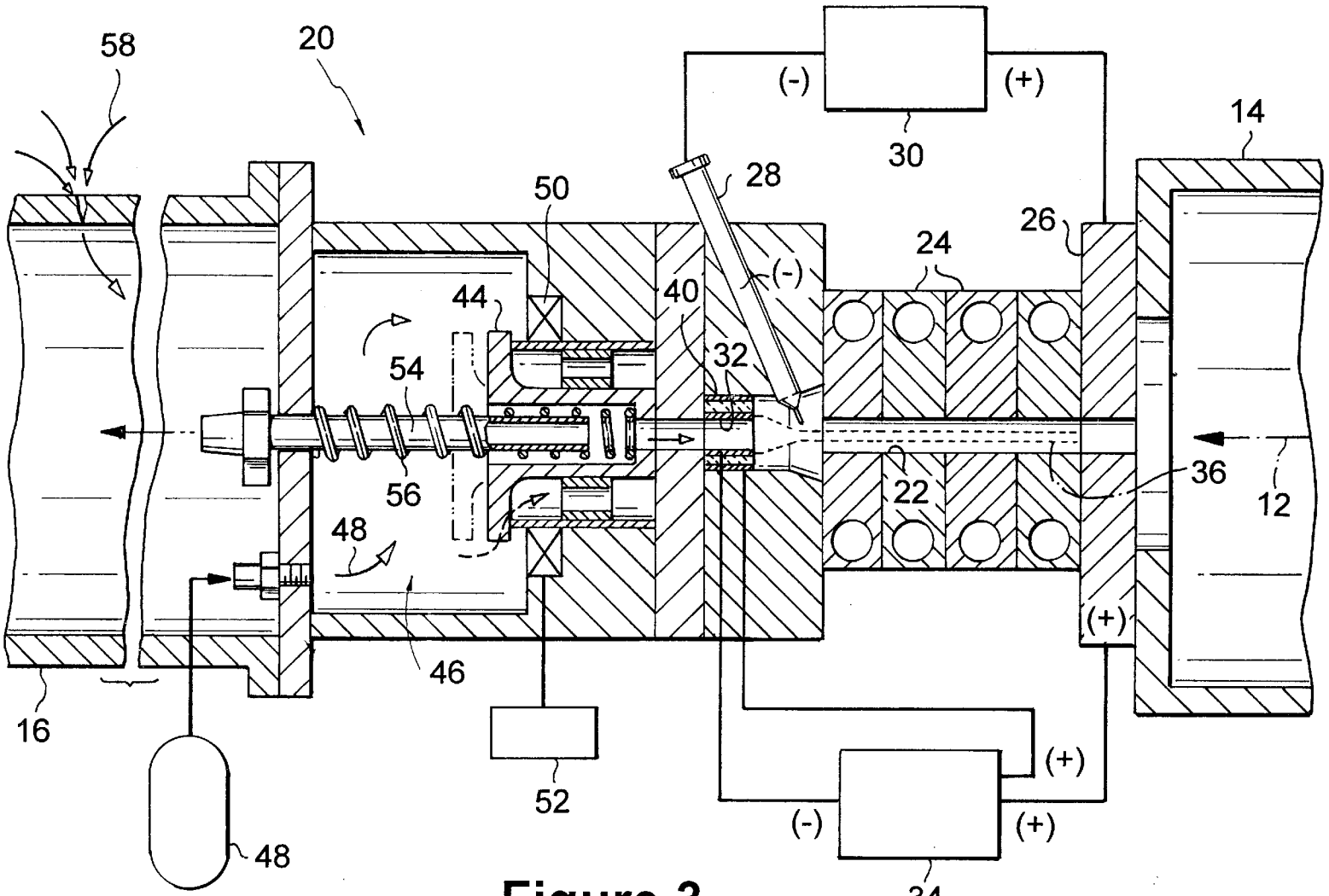
FIG. 3 is a partly sectional schematic view of the plasma valve illustrated in the extraction tube of FIG. 2 in accordance with an exemplary embodiment of the present invention.

The plasma valve 20 in accordance with an exemplary embodiment of the present invention is illustrated in more particularity in FIG. 3 disposed in series in the extraction tube 14 through which the beam 12 is transmitted under vacuum. In this exemplary embodiment, the plasma valve includes an elongate plasma confinement channel 22 defined within the center bore of a plurality of axially stacked together cooling plates 24 through which a suitable coolant is circulated for cooling the apparatus and stabilizing the resulting plasma formed during operation.

A first or primary anode 26 is disposed at one end of the channel, and a first or primary cathode 28 is disposed at an opposite end of the channel.

A primary electrical power supply 30 is operatively joined to the primary anode and cathode 26,28 for maintaining the developed plasma in arc mode in the same manner as the plasma window, with the primary power supply 30 being operated at a relatively high current greater than about 10 amps, and a relatively low voltage less than about 100 volts.

The primary cathode 28 is preferably in the form of a conventional needle cathode having sharp distal ends, made of Thoriated-Tungsten for example as in the plasma window, with three of the cathodes 28 being equally spaced apart around the circumference of the plasma channel. However, as indicated above, glow discharge ignition of the plasma using the primary cathodes 28 themselves is too slow for use in effecting the fast-response plasma valve for the present invention.

Accordingly, the plasma valve additionally includes a secondary ignition or trigger cathode 32 disposed adjacent the tip ends of the primary cathodes 28 at the plasma channel. A secondary or ignition electrical power supply 34 is operatively joined to the primary anode 26 and the ignition cathode 32 for quickly igniting and initiating a plasma 36 in the confinement channel. The ignition power supply 34 is preferably operated at high voltage of about 18 kV and at high current, on the order of about 1,000 amps or more.

In this way, the plasma 36 may be initiated or ignited substantially instantaneously using the ignition cathode 32 and then maintained by the primary cathode and power supply thereafter, with the plasma having a sufficiently high pressure of about one atmosphere, for example, for preventing vacuum loss in the extraction tube 14.

Although the plasma valve 20 illustrated in FIGS. 2 and 3 could be operated indefinitely with the high pressure plasma effectively closing the beamline from vacuum loss, the plasma valve need only be operated for a relatively short time until a second valve 38 disposed upbeam therefrom in the extraction tube 14 is suitably closed for isolating the downbeam portion of the extraction tube therefrom. The second valve 38 may have any conventional form such as those mechanical valves presently used in the NSLS or APS. The ignition cathode 32 is illustrated in more detail in FIG. 4 and preferably includes a plurality or multitude of electrode fibers 32*a* extending axially outwardly from one end of the main cathode 32 defining a body in a preferred tubular form. The cathode fibers 32*a* are preferably carbon fibers each having a diameter of a few microns which is substantially narrower than the diameter of the cathode needles which are about 0.5–1 mm in diameter. The narrow diameter carbon fibers 32*a* extend in a ring around the perimeter of the ignition cathode 32 and may number in the thousands or more.

A particular advantage of the fiber cathode is the ability for each fiber to carry a substantial electrical current, with the collective multitude of fibers carrying high current of about 1,000 amps or more for example. And, the correspondingly high voltage of about 18 kV, for example, may be applied to the cathode fibers 32*a* during the rapid plasma ignition sequence.

With this exemplary configuration, the plasma valve 20 may be operated for igniting and initiating the plasma 36 firstly with the ignition cathode 32 within about one microsecond. The ignition cathode 32 then sustains the so initiated plasma for up to about a few milliseconds as the cathode fibers 32*a* are consumed. And, the ignited plasma 36 is then maintained by the primary cathodes 28 thereafter.

The plasma 36 generated during the ignition sequence using the ignition cathode 32 achieves a substantially high pressure of about one atmosphere to prevent vacuum loss through the plasma channel 22. The high pressure plasma is then maintained as long as desired by operation of the primary cathode 28 and cooperating anode 36. The cathode fibers 32*a* by nature of their small size are consumed at least in part, or in full, during the ignition sequence for initiating the plasma which is then maintained at high pressure using the primary cathodes.

The specifically configured ignition cathode 32 permits the near instantaneous ignition of a high pressure plasma within microseconds after which the primary cathodes 28 take over for maintaining the plasma for blocking vacuum loss from the beamline.

Figure 4:
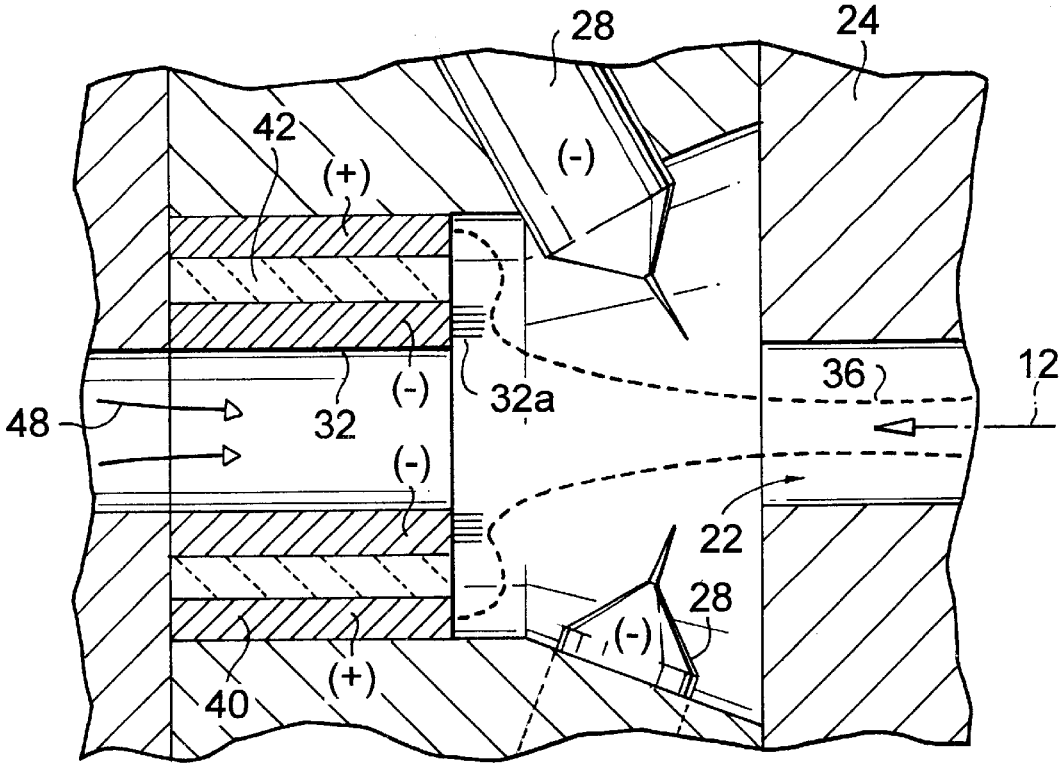
FIG. 4 is an enlarged, axial sectional view through a cathode portion of the plasma valve illustrated in FIG. 3 in accordance with one embodiment.

In one embodiment, the ignition cathode 32 cooperates with a secondary trigger or ignition anode 40 illustrated in FIGS. 3 and 4 which is disposed adjacent the ignition cathode, and operatively joined to the ignition power supply 34.

The ignition anode 40 illustrated in FIG. 4 preferably comprises a tubular electrode surrounding the tubular ignition cathode 32, with a tubular ceramic electrical insulator 42 disposed concentrically therebetween for effecting ignition flashover thereat. Since the plasma confinement channel 22 forms a portion of the beamline along which the beam 12 travels under vacuum, the cathodes 28,32 are also exposed to the corresponding vacuum. In an ultrahigh vacuum of about 10–10 Torr, few gas molecules are available for initiating the plasma.

By providing a relatively high voltage of about 18 kV across the secondary cathode 32 and anode 40, electrons can accumulate on the ceramic insulator for effecting flashover to ignite the plasma production.

Figure 5:
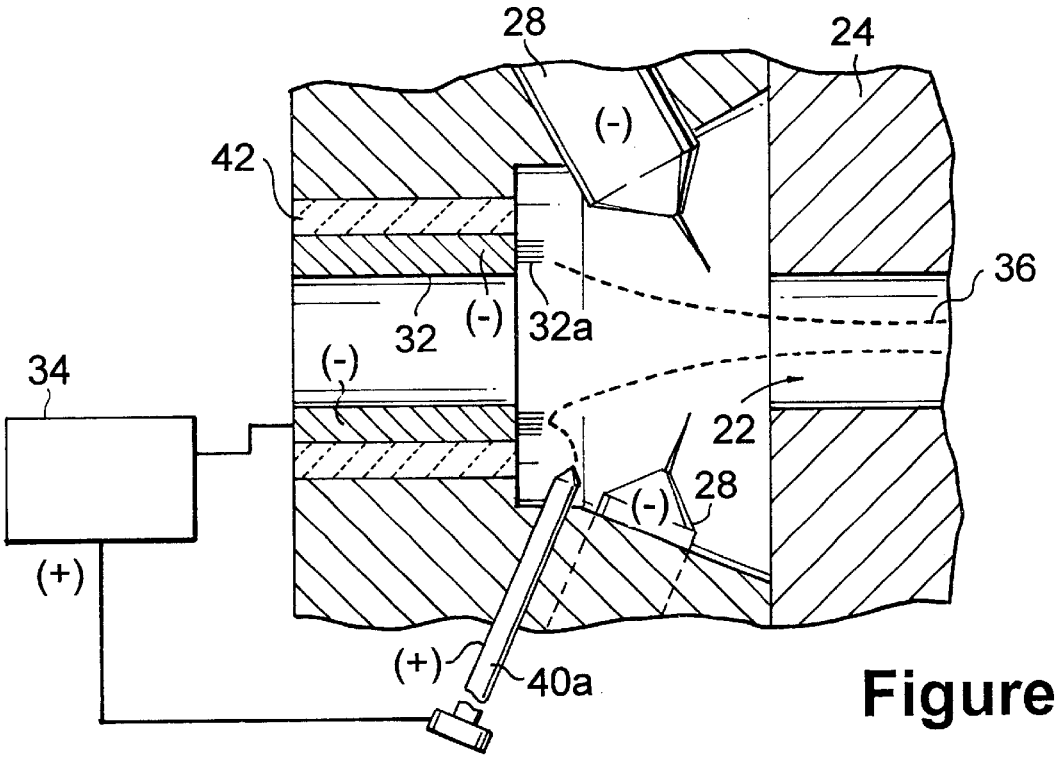
FIG. 5 is an axial view, like FIG. 4, of the cathode region of the plasma valve in accordance with another embodiment of the present invention.

FIG. 5 illustrates an alternate embodiment of the ignition anode in the form of an electrode rod 40a disposed between the ignition cathode 32 and the primary cathodes 28. This embodiment may be used for high vacuum systems up to about 10–5 Torr in which more gas molecules are available than in the ultrahigh vacuum embodiment illustrated in FIG. 4. The ignition rod 40*a* cooperates with the ignition cathode 32 and is powered with a high voltage of about 18 kV for igniting an electrical arc in the available gas molecules under high vacuum for initiating the plasma.

In both embodiments disclosed above, the ignition cathode and anode are used for quickly initiating the plasma in a vacuum, but, means are also provided for supplying an ionizing material adjacent the primary and ignition cathodes 28,32 for sustaining the plasma.

FIG. 3 illustrates one form of the means for supplying ionizing material to the cathodes. These means include a tubular ignition valve 44 having a central bore coaxially aligned with the plasma channel 22 downbeam of the ignition cathode 32. The ignition valve 44 may have any conventional form such as a gas-puff valve which is configured for operating extremely fast within about 100 microseconds for gas injection. Such gas-puff valves are disclosed in Review of Scientific Instruments 49,872 (1978) by A. Fisher, F. Mako, and J. Shiloh. They are also commercially available from Applied Pulse Power, Inc., Ithaca, New York.

The ignition valve 44 is disposed in a suitable plenum 46 which surrounds the valve for containing an ionizing material in the form of a gas 48 such as helium, argon, or nitrogen for example.

An electromagnetic coil 50 surrounds the ignition valve 44 and is operatively joined to an electrical power supply 52. A supporting tube or conduit 54 extends into the valve bore and is surrounded by a compression spring 56 which maintains the valve 44 in sealing closed contact against its seat. The tube 54 is coaxially aligned with the plasma channel 22 and permits unobstructed transmission of the beam 12 through the valve 44 and tube 54 to the user station 16 during normal operation.

During operation, the plenum 46 is filled with a suitable high pressure ionizing gas which is sealed by the ignition valve 44 from entering into the beamline or plasma channel portion thereof. During activation, the power supply 52 provides a suitable electrical current to the coil 50 for generating a large magnetic field therein with a corresponding eddy current in the valve 44 itself. The valve is electrically conducting, such as copper, and produces an opposing magnetic field which rapidly propels the valve away from the coil thus separating the valve from its seat for permitting the ionizing gas 48 to enter the beamline and flow into the plasma channel in the region of the primary and secondary cathodes.

Furthermore, in the event of a vacuum leak in the user station 16 illustrated in FIG. 3 as represented by an exemplary crack in the housing thereof, ambient air 58 will be drawn into the station 16 and will flow upbeam to the plasma channel wherein it is stopped by the high pressure plasma 36 formed in the plasma valve. The air, itself, may also be used to sustain the plasma.

In the exemplary embodiment illustrated in FIG. 3, the plasma channel 22 includes first and second apertures or ports at opposite axial ends thereof through which the beam 12 is transmitted. The vacuum found in the extraction tube 14 is effected at the upbeam port, and extends to the downbeam port and to the user station 16 during normal operation.

The ignition cathode 32 and primary cathodes 28 are configured as described above to effect the high pressure plasma 36 to seal the plasma channel 22 against gas leakage therethrough to maintain the vacuum on the upbeam side of the channel.

In the exemplary embodiment illustrated in FIG. 3, the primary anode 26 is disposed at the first port on the upbeam side of the channel. The primary cathodes 28, ignition cathode 32, and ignition anode 40 are correspondingly disposed at the opposite axial end of the channel at the downbeam second port thereof. In this configuration, an elongate, tubular high-pressure plasma 36 fills the plasma channel when the plasma valve is energized for preventing vacuum leakage therethrough. And, the cooling plates 24 stabilize the elongate plasma in the same manner as that for the plasma window identified above.

Figure 6:
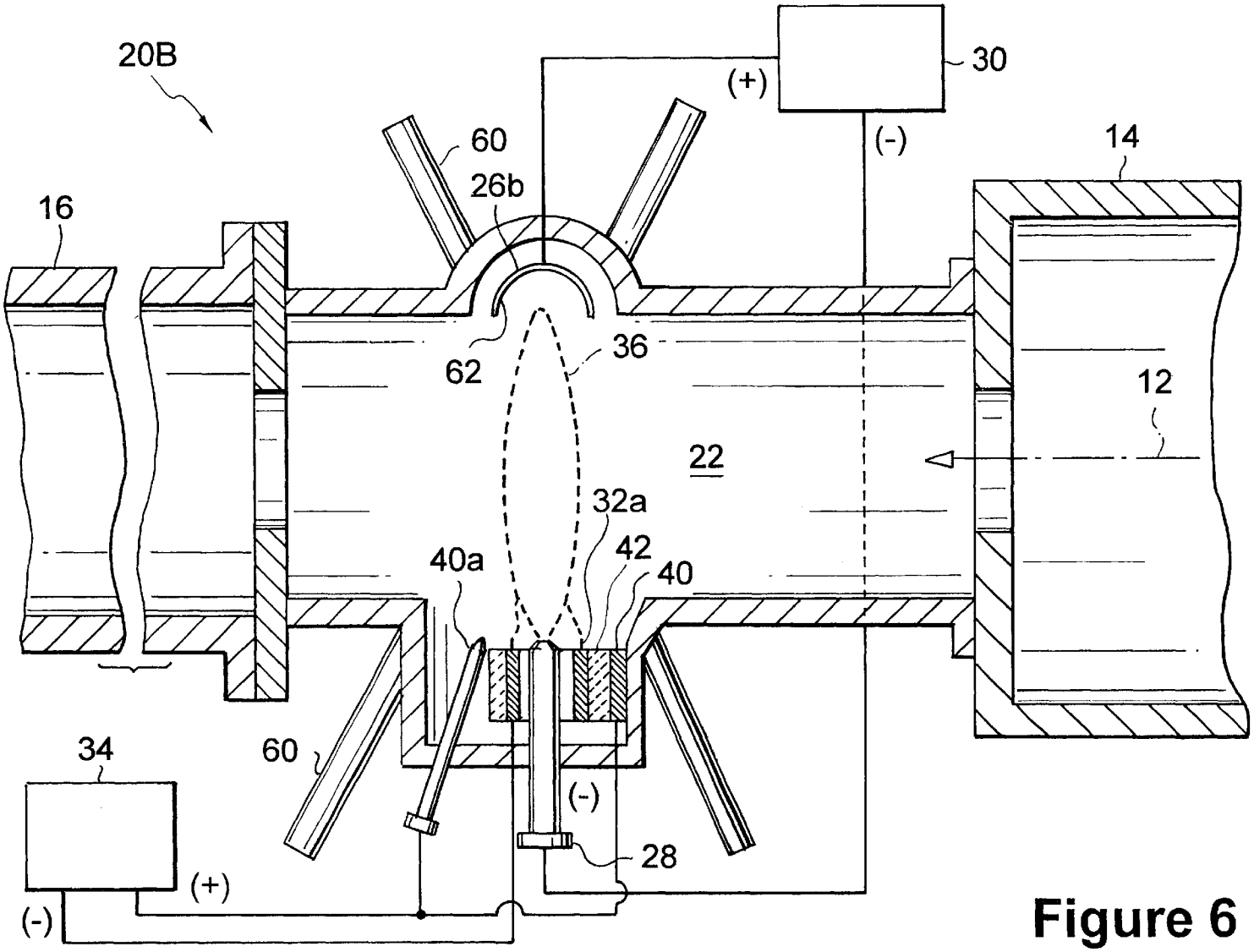
FIG. 6 is an axial sectional view of the plasma valve illustrated in FIG. 2 in accordance with an alternate embodiment of the present invention.

Illustrated in FIG. 6 is another embodiment of the plasma valve designated 20B disposed in series in the extraction tube 14 and configured for developing the high-pressure plasma 36 in sheet form transversely to the axial direction of the beamline. In this embodiment, the primary anode 26*b* is disposed on one transverse end or side of the plasma confinement channel 22 axially between the first and second ports at the upbeam and downbeam ends of the channel. The primary cathode 28, ignition cathode 32*a*, and ignition anode in either form 40 shown on the right, or form 40*a* shown on the left, are disposed on an opposite transverse sides of the plasma channel between the two port ends thereof. And, a pair of magnetic poles 60 extend along the opposite sides of the channel for magnetically confining the plasma 36 to sheet form for transversely blocking the plasma channel when the plasma valve is energized.

In this embodiment, the means for supplying an ionizing material for sustaining the high pressure plasma during ignition is in the form of an ablative material 62 lining the primary anode 26*b* for effecting metal vapor discharge therefrom. For example, the primary anode 26*b* may be formed of gold or lead which ablates during the plasma formation process to supply the initial ionizing material therefor.

In the alternate embodiment illustrated in FIG. 6, the primary anode 26*b* is concave facing the primary cathode 28 to focus the plasma ions in developing the plasma sheet 36.

In both embodiments illustrated in FIGS. 3 and 6, plasma ignition occurs in about a microsecond which is a million times faster than plasma ignition in the plasma window. The ionizing gas 48 or ablative vapor material 62 feed the ignition process to rapidly form the high pressure plasma which can block atmospheric pressure during the short interval until the plasma arc discharge is maintained by the primary cathodes and anode.

The fiber-tip ignition cathodes 32 operate at high current and voltage during the ignition sequence for initially forming the high-pressure plasma and sustaining it for up to about 100 microseconds as the fibers are consumed. The ionizing gas 48 or ablative material 62 then sustain the high pressure plasma up to a few milliseconds until steady state operation of the plasma is maintained by the primary cathodes and anode. The primary cathodes and anode can maintain the high pressure plasma indefinitely for as long as suitable ionizing material is provided, which may simply include the air introduced due to the downbeam vacuum leak.

However, as indicated above, the second valve 38 illustrated in FIG. 2 may be operated following activation of the plasma valve 20 to mechanically seal the extraction tube 14 after the plasma valve has completed its high speed interruption of the beamline for preventing degradation of the upbeam vacuum environment. Although the plasma valve has been described above in accordance with preferred embodiments for use in rapidly sealing the evacuated extraction tube 14, it may be used in any other evacuated tube in which high speed vacuum interruption is desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly,

What is desired to be secured Letters Patent of the United States is the invention as defined and differentiated in the following claims in which we claim:

1. A plasma valve comprising:

a plasma confinement channel;

a primary anode disposed at one end of said channel;

a primary cathode: disposed at an opposite end of said channel;

an ignition cathode disposed adjacent said primary cathode;

an ignition power supply operatively joined to said primary anode and said ignition cathode for igniting a plasma in said channel; and a primary power supply operatively joined to said primary anode and primary cathode for maintaining said plasma after ignition thereof to prevent leakage of atmospheric pressure through said channel.

2. The valve according to claim 1 wherein said ignition cathode comprises a plurality of fibers.

3. The valve according to claim 2 further comprising an ignition anode disposed adjacent said ignition cathode, and operatively joined to said ignition power supply.

4. The valve according to claim 3 further comprising means for supplying an ionizing material adjacent said primary and ignition cathodes.

5. The valve according to claim 4 wherein said supplying means comprise:

a tubular ignition valve having a central bore coaxially aligned with said plasma channel;

a plenum surrounding said ignition valve for containing ionizing material in gas form; and an electromagnetic coil surrounding said ignition valve for axial translation thereof to discharge said ionizing gas into said plasma channel.

6. The valve according to claim 4 wherein said supplying means comprise an ablative material lining said primary anode for effecting metal vapor discharge therefrom.

7. The valve according to claim 6 wherein said primary anode is concave facing said primary cathode.

8. The valve according to claim 4 wherein said ignition anode comprises a tubular electrode surrounding said ignition cathode, with a tubular ceramic insulator therebetween, for effecting ignition flashover thereat.

9. The valve according to claim 4 wherein said ignition anode comprises an electrode rod disposed between said ignition cathode and said primary cathode.

10. The valve according to claim 4 wherein:

said plasma channel includes first and second ports at opposite ends thereof;

a vacuum is effected at one of said ports; and said ignition cathode and primary cathode are configured to effect a high-pressure plasma to seal said plasma channel against gas leakage therethrough to maintain said vacuum.

11. The valve according to claim 10 wherein:

said primary anode is disposed at said first port; and said primary cathode, ignition cathode, and ignition anode are disposed at said second port.

12. The valve according to claim 10 wherein:

said primary anode is disposed on one side of said plasma channel between said first and second ports; and said primary cathode, ignition cathode, and ignition anode are disposed on an opposite side of said plasma channel between said first and second ports.

13. The valve according to claim 10 in combination with:

an evacuated ring circulating a radiation beam therearound;

a plurality of extraction tubes operatively joined to said ring for receiving said beam therefrom; and each of said tubes includes said plasma valve in series therein for channeling said beam therethrough when said plasma valve is de-energized, and for blocking vacuum loss therethrough by said plasma when said plasma valve is energized.

14. The method of using said plasma valve according to claim 1 comprising:

igniting said plasma with said ignition cathode within about one microsecond;

sustaining said plasma with said ignition cathode for a plurality of milliseconds; and maintaining said ignited plasma with said primary cathode thereafter.

15. The method according to claim 14 further comprising:

igniting said plasma with said ignition cathode to achieve a high pressure plasma effective to prevent vacuum loss through said plasma channel; and maintaining said high pressure plasma with said primary cathode.

16. The method according to claim 15 further comprising consuming said ignition cathode at least in part during said plasma ignition.

* * * * *